US005641307A

United States Patent [19]

Gerrans

[11] Patent Number: 5,641,307

[45] Date of Patent: Jun. 24, 1997

[54] MARINE ELECTRICAL CONNECTOR

[76] Inventor: Al Gerrans, 13303 Skinner Rd., Cypress, Tex. 77429

[21] Appl. No.: 347,797

[22] Filed: Dec. 1, 1994

[51] Int. Cl.[6] ..... H01R 13/58

[52] U.S. Cl. ..... 439/606; 439/693

[58] Field of Search ..... 439/606, 736, 439/445, 447, 686, 695, 693

[56] References Cited

U.S. PATENT DOCUMENTS

| | | | |
|---|---|---|---|
| 2,866,957 | 12/1958 | Raypholtz | 439/606 |
| 3,497,864 | 2/1970 | Barnet | 439/278 X |
| 3,643,208 | 2/1972 | Massa, Jr. | 439/606 |
| 3,693,133 | 9/1972 | Harbonn et al. | 439/278 |
| 4,461,529 | 7/1984 | Fariss | 439/736 X |
| 4,589,939 | 5/1986 | Mohebban | 439/933 X |
| 4,861,288 | 8/1989 | Friedman | 439/933 X |
| 5,100,341 | 3/1992 | Czyz et al. | 439/447 |
| 5,120,268 | 6/1992 | Gerrans | 439/736 |

*Primary Examiner*—Gary F. Paumen
*Attorney, Agent, or Firm*—Matthews & Associates

[57] ABSTRACT

A connector for use in marine environment made of a hard plastic insert within which electrical pins are fixed and molding soft plastic to at least one side thereof on at least one side and along the longitudinal axis thereof for water proofing and shock resisting purposes, as well as, utilizing a core of potting compound which is poured in a liquid form and cures to a sold state which can therefore add to the stability waterproof and shock resistant characteristics of the present invention.

5 Claims, 2 Drawing Sheets

MARINE ELECTRICAL CONNECTOR

BACKGROUND OF THE INVENTION

Underwater electrical cables and marine conductors in general cause major problems when they begin to leak. Leakage of course is common due to the fact that such cables, and their connectors, commonly operate in subsurface environments or in near surface atmospheric environments characterized by extreme salt and humidity. The primary water and humidity sealing means in underwater connectors is generally the insulation encapsulating the strands of individual conductors, or it is an encapsulating plastic around the machined stainless steel connector. Frequently, these connectors are made of corrosion resistant metals, such as stainless, or the like, and are coated with a plastic coating for the purpose of precluding entry of moisture.

Further, in marine seismic operations, underwater electrical plugs or connectors are needed to connect power and instrumentation conductors to other equipment, such as seismic sound generators, i.e., air guns. These "guns" are used as a sound source to obtain acoustic reflections from the sea-floor. Typically, they are fired every ten to fifteen seconds producing extremely strong pressure waves. As a result, the electrical cables, conductors and connectors are subjected to a great deal of structural abuse, and normally they may not last for extended periods of time before developing leaks or other operations defects. Typically, these components, such as electrical connectors, are exposed to such blasting forces and also to the extremely adverse nature of the environment, and will not last long if they are not able to withstand the conditions. Therefore, all of the electrical connectors and other components used in these harshest of environments must necessarily withstand repeated explosive forces on their exteriors while allowing for a degree of flexibility there within lest the internal conductor be jolted loose from its external housing.

The inventor originally believed that the best way to accomplish a marine electrical connector which would satisfactorily handle the type of punishment which would be incurred based upon the foregoing conditions was by having a ridged or very strong external housing material which would not fracture while simultaneously precluding leakage from the environment and mounting the electrical conductor inside the housing within a flexible shock absorbent material. The shock absorbent material was to allow for the repeated percussive forces, which would be incurred without producing a short in the circuit. This previous invention is described and claimed in U.S. Pat. No. 5,120,268, which was issued on Jun. 9, 1992. In that application, the Applicant pointed out that he was unaware of electrical conductors which utilized flexible shock absorbent interiors, and that it was common for the exterior and interior of electrical connectors to be comprised of different materials, such as, for example, metal and rubber, thus requiring difficult and expensive bonding techniques which frequently results in unreliable adhesion therebetween. Applicant further notes, that this is believed to be true whenever different materials of substantially different hardness and/or density are bonded together. Applicant's concepts remain true to date in the present application is intended to expand upon those principals in light of the development of a new and improved marine electrical connector.

Applicants main advantage with respect to the previous invention was that two types of plastic were being utilized to comprise the electrical connector in Applicant's previous invention were not made of stainless steel or any other metal alloy normally resistant to corrosion and other abusive environmental conditions, thereby greatly decreasing the cost of the connector. Instead, Applicant utilized a method for making reliable multi-component electrical connectors which, theretofore, were not capable of reliable permanent fusion to one another. The dual material electrical connector of the invention was characterized by a flexible shock absorbent internal core and relatively hard external housing each fusionly connected to one another in an irrevocable bond. Applicant discovered the use of the glass impregnated external housing consistent of a hard plastic material and an interior shock absorbent material of substantially the same plastic which obviated the short comings of the prior art and which not only enabled the production of electrical connectors capable of operational advantages over that which had been known theretofore but which also markedly simplified the manufacturing and reduced the expense thereof.

In the present invention, Applicant has designed away from the hard external housing and instead now utilizes a soft plastic external housing which is fused to a connector element and which is still more than sufficiently capable of withstanding the shocks and abuses incurred by marine electrical connectors and is even less susceptible to leakage than the prior art. Further, the present invention greatly reduces the amount of steps required to manufacture the connector, thereby, once again, reducing cost and time in the manufacturing process, yet still yielding an even more desirable end product. The present invention is also even more capable of providing leakage protection against the elements than the prior art of connectors.

Accordingly, it is a primary object of the invention disclosed hereinafter, to solve the problems described above, and which can be utilized in marine seismic operations.

Another object of, the present invention is to improve the shock absorbent capabilities of electric connectors through the use of a flexible external covering that minimizes electrical circuit disturbance.

Still, another object of the present invention is to provide a marine connector which not only has greater shock absorbent capabilities, but also has greater leakage prevention characteristics for use in subsea conditions.

Still, another object of the present invention is to provide a marine connector which remarkably reduces the substantial cost associated with prior art connectors characterized by a plurality of component parts and manufacturing steps, thereby providing for a more cost effective and time saving manufacturing process.

SUMMARY OF THE INVENTION

The present invention provides an electrical connector having a flexible, resilient, external plastic covering, which encapsulates the electrical connector insert which preferably is made of a polyurethane material. The insert base is also made of a plastic, and therefore, allows for a fusion of the soft external covering with the insert upon the application of heat, each to the other and therefore, the integral body of the two pieces is highly suited for its use in underwater seismic exploration.

DESCRIPTION OF THE PREFERRED EMBODIMENT

Figure 1:
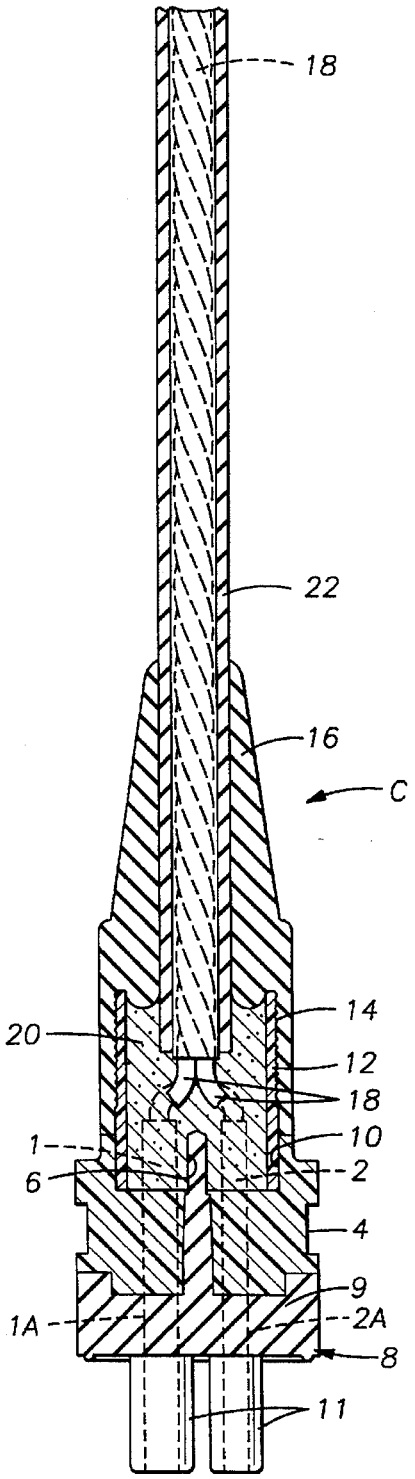
FIG. 1 illustrates a cross-sectional view of an electrical connector in accordance with the principals of this invention.
Figure 3:
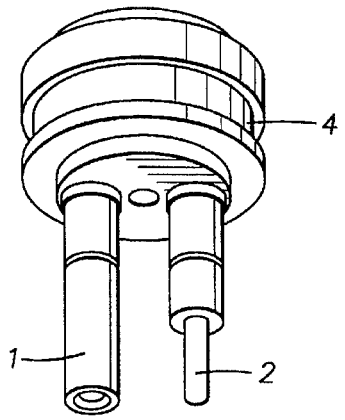
FIG. 3 is an isometric view of the connection inserts utilized with the present invention.
Figure 1A:
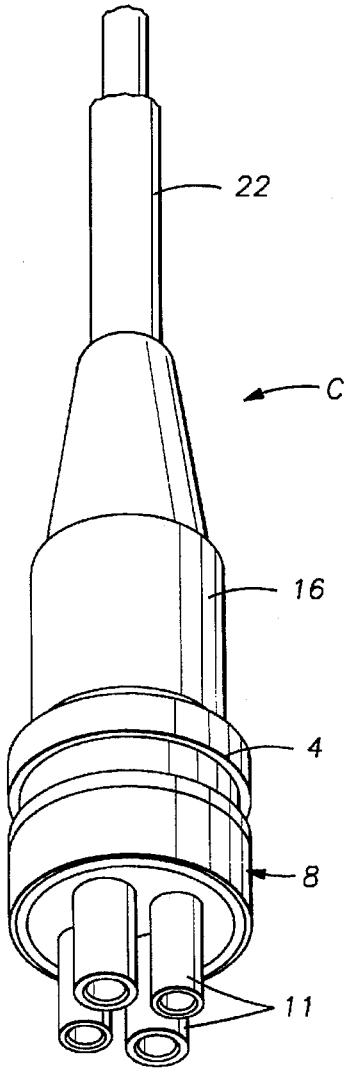
FIG. 1A illustrates an isometric view of an electrical connector in accordance with the principals of this invention and as disclosed in cross-section in FIG. 1.

Referring to FIG. 1 which discloses a preferred embodiment of the present invention the electrical conductor pins 1 and 2 are encased in a hard plastic short cylindrical insert base 4. This makeup is shown better in FIG. 3. The insert base 4, also contains a cylindrical channel 6, which extends along the longitudinal axis and substantially in the center of insert 4. An internal annular lip 10 also extends around the inside of insert 4. The insert base 4 is manufactured by molding the plastic around connector pins 1 and 2. A soft polyurethane material 8, such as B. F. Goodrich Estane® 58863 or 58881 is molded around the outwardly extending electrical connector pins 1A and 2A. The molding process is accomplished such that a foundation portion 9 follows the basic outline of base insert 4 while outwardly extending fingers 11 cover any connector pins such as 1A and 2A.

A back shell piece 12 is then friction fitted along the internal annular lip 10. Back shell 12 can also contain, as shown, external grooves or threads 14, which enhance and increase the co-efficient of friction along that outer surface to allow for better holding of the soft polyurethane outer coating 16. However, prior to molding the outer coating 16 and at any time prior thereto, the termination of the electrical conductor wires 18 must be made at pins 1 and 2. Further, prior to the molding of outer covering 16, a potting compound 20 must be poured into and allowed to dry within the back shell 12 and internal annular lip 10 of insert 4. Potting compound 20 provides further water proof protection of the electrical connectors, further strengthens the connection itself between the electrical conductors 18 and electrical pins 1 and 2, and still further provides additional shock absorbing capabilities to the entire conductor piece denoted as C. The tail over mold 16 is essentially the last step said over-mold encompassing the electrical conductor insulation 22.

Figure 2:
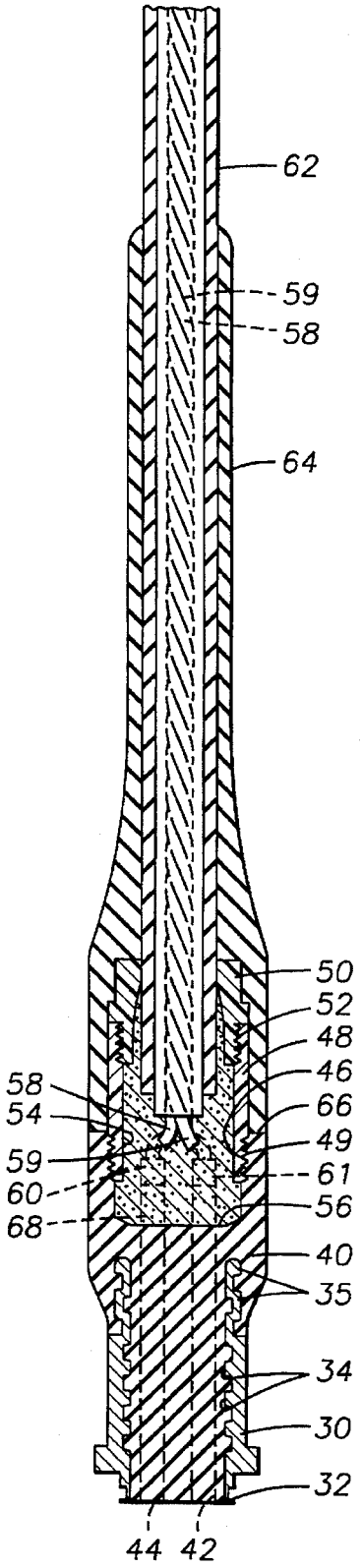
FIG. 2 is a cross-sectional view of an alternative embodiment of an electrical connector in accordance with the principals of this invention.
Figure 2A:
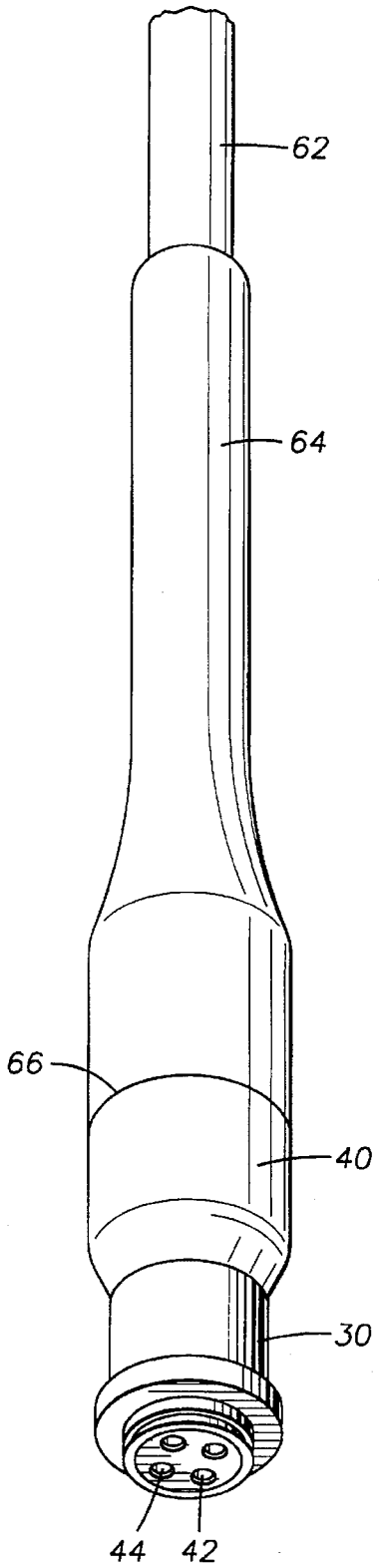
FIG. 2A illustrates an isometric view of an electric electrical connector in accordance with the alternative embodiment of the principals of this invention as disclosed in cross-section in FIG. 2.

Another embodiment of the present invention is disclosed in FIG. 2. In that embodiment, a soft over mold of the pins such as that identified as S in FIG. 1 is not required since a steel connector piece 30 must be used. Disclosed is the male portion which fits within an external female clamp for the corresponding connector not shown.

In the embodiment of FIG. 2, steel connection piece 30 is hollow and cylindrical with an outwardly protruding annular lip 32 at its most distal end and which includes a number of internal extending annular protrusions 34, as well as, outwardly extending angular protrusions 35 to provide for a better grip to the molding plastic 40 in which connector piece 30 is set. The molded plastic 40 is of a glass impregnated polyurethane variety best exemplified by Dow Chemical ISOPLAST® 201, a polyurethane, which is filled from 40 to 60% by weight, with fiberglass.

As disclosed in Applicant's previous patent, when this glass impregnated polyurethane is molded it sets up as a rather hard, if not semi-rigid body. The glass imports strength, as well as, rigidity to the body. In the event it is designed to increase the hardness of the plastic to better withstand abrasion and/or harsh treatment and usage, the fiberglass content may be increased or conversely lowered. It is believed that a fiberglass content in the range of 15% to 65% by weight would generally accomplish the objects of the invention as described herein. The hard plastic housing material 40 is also molded about longitudinally extending electrical connector pins 42 and 44. While only two connector pins are shown in this embodiment, connector pins can number from 1 to several depending on the desired connection to be made.

Housing portion 40 also contains internal threads 46 which correspond to and allow for the threaded engagement of back shell 48. The internal threads are located on the inside of annular surface 66. Back shell 48 contains external threads 49 corresponding to internal threads 46 of housing 40. A pressure nut 50 threadedly engages back shell 48 at 52. Potting compound is then injected into the internal area 54 defined by the inner wall 56 of hard plastic housing portion 40, back shell 48 and pressure nut 50. The potting compound accomplishes the same functions and purposes as that described with respect to the embodiment described above. The potting compound and pressure nut are only applied after the electrical connectors 42 and 44 have already been terminated with electrical conductors 58 and 59 at points 60 and 61. Since the electrical conductors insulation material 62 remains unprotected, a soft plastic tail over-mold 64 is applied and irrevocably bonds with the electric conductor insulation 62, pressure nut 50, back shell 48 and annular surface 66 of housing portion 40 at the terminus of surfaces 64 and 40.

METHOD OF MANUFACTURING

Though the method of manufacturing is somewhat described above it will be discussed in a more step-by-step fashion herein. For the embodiment of FIG. 1, the hard plastic insert piece 4 is molded about conductor pins 1 and 2. A soft plastic over-mold is then made over the outwardly extending pins 1A and 2A. A back shell piece is then snapped into and held into place by internal annular lip 10. By this point, and at any time prior hereto, electrical conductors 18 must have been terminated into electrical pins 1 and 2. A potting compound 20 is then poured into the cavity defined by insert 4 and back shell 12. The external portion 14 of back shell 12 can also include threads or knurls as shown in FIG. 1 to aid in gripping the soft tail over mold 16 which is now accomplished by injection molding.

The embodiment of FIG. 2 is best manufactured by first molding a glass impregnated polyurethane about external clamping mandril 30 and electrical connector pins 42 and 44. The inwardly extending portion of this outer housing 40 is comprised of an annular bore which extends into and generates an internal chamber 54. The annular lip 66 of housing portion 40 will generally contain internal threads 46 to which a back shell 48 is threaded. At this point, or prior hereto, electrical conductors 58 and 59 must be terminated at connector pins 42 and 44 at 60 and 61. A pressure nut 50 is then threaded into back shell 48 and potting material 54 is then injected or poured into the chamber defined by internal bore 68 of housing portion 40. This arrangement also provides resilience against the environmental stress incurred by sub-sea connectors. A soft polyurethane tail over mold 64 is then injection molded thereabout to create the remaining portion of the housing and terminates at the innermost lip 66 of hard plastic housing portion 40 and irrevocably bonds to said lip as well as the external faces of back shell 48, pressure nut 50 and electrical conductor insulation 62.

It is to be understood that the form of the invention herein shown and described is to be taken as a preferred example, and that numerous variations will be obvious to those skilled in the art and in light of the teachings of this specification, without departing from the scope of the hereinafter claimed subject matter.

I claim:

1. An electrical connector comprising:

a substantially cylindrical base having a concave end and a substantially flat end;

an electrical pin connected to an electrical wire, said pin fixed within and protruding outwardly from both ends of said base;

a substantially cylindrical back shell attached within said concave end of said base and extending outwardly therefrom;

an epoxy inner core surrounding said pin within said back shell; and a soft polyurethane covering substantially enclosing said base therein and extending from said flat end and said concave end; wherein said soft polyurethane covering extending from said substantially flat end forms a finger immediately surrounding and substantially enclosing said electrical pin.

2. The electrical connector of claim 1, wherein:

said soft polyurethane covering is irrevocably bonded to said base.

3. The electrical connector of claim 1, wherein:

said base further includes a channel formed therein for disposing a portion of said soft polyurethane covering.

4. The electrical connector of claim 1, wherein:

a radially outward face of said shell is grooved.

5. An electrical connector comprising:

a substantially cylindrical, open ended shell;

an electrical pin connected to an electrical conductor within said shell;

an epoxy inner core encompassing said electrical conductor and said electrical pin connection within said shell, said pin extending outwardly from said inner core; and a polyurethane covering extending from and immediately surrounding an outwardly projecting end of said pin, over said shell and over a portion of said electrical conductor.

* * * * *